US007436386B2

(12) United States Patent
Ishiguchi

(10) Patent No.: US 7,436,386 B2
(45) Date of Patent: Oct. 14, 2008

(54) TRANSMISSION TYPE DISPLAY DEVICE AND A METHOD FOR CONTROLLING ITS DISPLAY COLORS

(75) Inventor: Kazuhiro Ishiguchi, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 665 days.

(21) Appl. No.: 10/741,006

(22) Filed: Dec. 19, 2003

(65) Prior Publication Data

US 2004/0135750 A1 Jul. 15, 2004

(30) Foreign Application Priority Data

Dec. 19, 2002 (JP) ..... 2002-368767

(51) Int. Cl.
*G09G 3/36* (2006.01)

(52) U.S. Cl. ..... 345/102; 345/89

(58) Field of Classification Search ..... 313/112, 313/582, 587; 315/169.4; 345/63, 87–102, 345/690–693, 207, 589, 590, 591, 592–605; 349/109, 113, 122; 348/602; 715/745, 747
See application file for complete search history.

(56) References Cited

U.S. PATENT DOCUMENTS

| | | | | |
|---|---|---|---|---|
| 5,079,638 | A | 1/1992 | Kishi et al. | 358/448 |
| 5,289,291 | A | 2/1994 | Kishi et al. | 358/443 |
| 5,739,914 | A | 4/1998 | Chida et al. | 356/405 |
| 6,762,741 | B2 * | 7/2004 | Weindorf | 345/102 |
| 6,778,182 | B2 * | 8/2004 | Yamakawa | 345/589 |
| 6,987,498 | B2 * | 1/2006 | Ikeda et al. | 345/88 |
| 7,075,503 | B2 * | 7/2006 | Shinohara | 345/60 |
| 2004/0113924 | A1 * | 6/2004 | Jeong | 345/690 |

FOREIGN PATENT DOCUMENTS

JP 2-216 975 A 8/1990

OTHER PUBLICATIONS

Patent Abstracts of Japan, abstracting publication JP 09-049765, Senda + Murakami/Yokogawa Electric, pub. Feb. 18, 1997, based on application JP 07-202186 filed Aug. 8, 1995.
Asahina & Co., partial translation of JPO Office Action in 368 767/2002, dated Jul. 11, 2006.

(Continued)

*Primary Examiner*—Nitin Patel
(74) *Attorney, Agent, or Firm*—Milton Oliver, Esq.; Ware Fressola Van Der Sluys & Adolphson LLP

(57) ABSTRACT

An improved transmission type display device features a light source having plural emission colors and means for controlling the chromaticity of display images, and maintaining it with high precision. The device can be manufactured at low cost by easing the spectral sensitivity tolerances required for the chromaticity sensor. The transmission type display device displays color images by making light emitted from light sources pass through a color-blending part (400) and by controlling the light by an optical shutter (500). The device includes: at least three light detection devices (300) installed in positions closer to the light sources than is the optical shutter, and a light source control circuit which controls emission intensities of light sources of different colors to keep the display chromaticity constant so that sensitivity reading values of said light detection devices are kept constant.

The display chromaticity is preferably maintained according to the equation $D(\lambda)=S(\lambda)k(\lambda)/k'(\lambda)$ where $S(\lambda)$ is a light source spectrum, $k(\lambda)$ is a transmittance through an optical shutter (500) and $k'(\lambda)$ is a transmittance directly into color sensors (300).

21 Claims, 6 Drawing Sheets

OTHER PUBLICATIONS

Asahina & Co., partial translation of JP 368 767/2002 application text (3 pages).

Japanese Patent Office, Office Action (in Japanese) re application JP 368 767/2002 (two pages).

* cited by examiner

TRANSMISSION TYPE DISPLAY DEVICE AND A METHOD FOR CONTROLLING ITS DISPLAY COLORS

BACKGROUND OF THE INVENTION

The present invention relates to a transmission type display device and a method for controlling its display colors. To be more specific, the present invention relates to a transmission type display device which displays color images with plural light sources having different emission colors and which can control display chromaticity and maintain desired display chromaticity, and also relates to a method for controlling the display colors.

A transmission type display device composed of light sources having different emission colors enables white color (color temperature) to be displayed as white by changing the emission intensity of each light source.

This transmission type display device has less gradation deterioration, compared, for example, with a display device which calculates and corrects the numerical values of image data. This transmission type display device also offers a display with higher color purity by using light sources whose emission spectrums are narrow, such as a light-emitting diode (LED).

However, in such a transmission type display device, the chromaticity of display images changes as the emission intensity or emission spectrum of each color light source changes due to temperature or time. To reduce this change, it is necessary to adjust the emission intensity of each color light source by using a chromaticity sensor.

The chromaticity sensor used here preferably has a luminosity (spectral) characteristics (isochromat function: $x(\lambda)$, $y(\lambda)$, $z(\lambda)$) proposed by CIE1931 (published by International Commission on Illumination).

However, it is difficult to produce a sensor having this characteristic with high precision, so those sensors used in color luminosity meters contain various ideas (Please see Japanese Unexamined Patent Publication No. 49765/1997). Consequently, these sensors are too expensive to be provided in each display device. Installing such a sensor on the display surface of a display device disturbs the actual use of the display device, so it is generally preferable to install it not on the display surface but inside the display surface toward the light source side. Installing the sensor inside the display device means that no correction is applied to the spectral transmittance characteristics of the shutter part, which makes the colors actually displayed different from the colors detected by the sensor, because the transmittance characteristics of the shutter part is not constant throughout the whole wavelength of the visible light. This causes a problem that, however precisely the chromaticity sensor may be controlled, display colors change as the emission intensity or colors of the light sources changes.

SUMMARY OF THE INVENTION

In view of these circumstances, the present invention has an object of providing a transmission type display device which is composed of a light source having plural emission colors and which can control the chromaticity of display images, maintain it with high precision, and can be manufactured at low cost by easing the spectral sensitivity requirements required for the chromaticity sensor, and another object of providing a method of controlling its display colors.

The transmission type display device of the present invention can be a transmission type display device which is provided with plural light sources having different emission colors and which displays color images by making the light emitted from said light sources pass through a color-blending part and controlling the light by an optical shutter, the transmission type display device comprising: at least three light detection devices installed in positions closer to said light source than is said optical shutter; and a light source control circuit which controls the emission intensities of said light sources of different colors to keep the display chromaticity constant so that the sensitivity reading values of said light detection devices are kept constant, wherein the spectral sensitivities of said light detection devices have characteristics the same as or approximated to the characteristics obtained by multiplying the sum of the real number multiples of luminosity spectral characteristics by the spectral transmittance $k(\lambda)$ from said light sources to the display surface and then dividing by the spectral transmittance $k'(\lambda)$ from said light sources to the positions where said light detection devices are installed.

The transmission type display device of the present invention can be a transmission type display device which is provided with plural light sources having different emission colors and which displays color images by making the light emitted from said light sources pass through a color-blending part and controlling the light by an optical shutter, the transmission type display device comprising: at least four light detection devices which are installed in positions closer to said light source than is said optical shutter and whose spectral sensitivities have characteristics the same as or approximated to the characteristics obtained by multiplying the sum of the real number multiples of luminosity spectral characteristics by the spectral transmittance from said light sources to the display surface, dividing by the spectral transmittance from said light sources to the positions where said light detection devices are installed, and adding up the result with a real number; a calculation part which subjects the sensitivity reading values of said light detection devices to linear transformation to change into three values using a matrix of 3 rows and n columns when the number of the light detection devices is set to n; and a light source control circuit which keeps the display chromaticity constant by controlling the emission intensities of the light sources having different colors so as to keep the three calculation results constant.

The transmission type display device of the present invention can be a transmission type display device which is provided with plural light sources having different emission colors and which displays color images by making the light emitted from said light sources pass through a color-blending part and controlling the light by an optical shutter, the transmission type display device comprising: at least three light detection devices which are installed in positions outside the display region on the display surface side of said optical shutter; and a light source control circuit which keeps the display chromaticity constant by controlling the emission intensities of the light sources having different colors so as to keep the sensitivity reading values of said light detection devices constant, wherein spectral sensitivities of said light detection devices have characteristics the same as or approximated to the characteristics of the sum of the real number multiples of the luminosity spectral characteristics, and another optical shutter having the same characteristic as the display region of said optical shutter is provided in the positions where said light detection devices are installed.

The transmission type display device of the present invention can be a transmission type display device which is provided with plural light sources having different emission colors and which displays color images by making the light emitted from said light sources pass through a color-blending part and controlling the light by an optical shutter, the transmission type display device comprising: at least three light detection devices which are installed on a light path that passes through a small piece of said optical shutter having a similar spectral transmittance to said optical shutter, said light path being provided aside from a light path leading to the display surface by branching a light path which extends from said color-blending part to said optical shutter; and a light source control circuit which keeps the display chromaticity constant by controlling the emission intensities of the light sources having different colors so as to keep the sensitivity reading values of said light detection devices constant, wherein spectral sensitivities of said light detection devices have characteristics the same as or approximated to the characteristics of the sum of the real number multiples of the luminosity spectral characteristics, and another optical shutter having the same characteristic as the display region of said optical shutter is provided in the positions where said light detection devices are installed.

The transmission type display device of the present invention can be a transmission type display device which is provided with plural light sources having different emission colors and which displays color images by making the light emitted from said light sources pass through a color-blending part and controlling the light by an optical shutter, the transmission type display device comprising: at least four light detection devices which are installed outside the display region on the display surface side of said optical shutter and whose spectral sensitivities have characteristics the same as or approximated to the characteristics obtained by adding a real number to the sum of the real number multiples of luminosity spectral characteristics; a calculation part which subjects the sensitivity reading values of said light detection devices to linear transformation to change into three values through a matrix of 3 rows and n columns when the number of the light detection devices is set to n; and a light source control circuit which keeps the display chromaticity constant by controlling the emission intensities of the light sources having different colors so as to keep the three calculation results constant.

The transmission type display device of the present invention can be a transmission type display device which is provided with plural light sources having different emission colors and which displays color images by making the light emitted from said light sources pass through a color-blending part and controlling the light by an optical shutter, the transmission type display device comprising: at least four light detection devices which are installed on a light path that passes through a small piece of said optical shutter having a similar spectral transmittance to said optical shutter, said light path being provided aside from a light path leading to the display surface by branching a light path which extends from said color-blending part to said optical shutter, and whose spectral sensitivities have characteristics the same as or approximated to the characteristics obtained by adding a real number to the sum of the real number multiples of luminosity spectral characteristics, said at least four light detection devices having another optical shutter having the same characteristic as the display region of said optical shutter in the position outside the display region where said light detection devices are installed; a calculation part which subjects the sensitivity reading values of said light detection devices to linear transformation to change into three values using a matrix of 3 rows and n columns when the number of the light detection devices is set to n; and a light source control circuit which keeps the display chromaticity constant by controlling the emission intensities of the light sources having different colors so as to keep the three calculation results constant.

The method for controlling display colors of a transmission type display device of the present invention can be a method for controlling display colors of a transmission type display device which is provided with plural light sources having different emission colors and which displays color images by making the light emitted from said light sources pass through a color-blending part and controlling the light by an optical shutter, said method comprising the steps of:

blending colors of the light emitted from said light sources and then detecting the colors with at least three light detection devices installed in positions inward to said light source than said optical shutter; converting the detected light into numbers; finding error values from the numerical values and the design values of said light detection devices and then multiplying the gains or losses of the output of the light sources calculated from said light detection devices by the previous output values; and controlling the emission intensities of said light sources having different colors based on said multiplied values so as to keep display chromaticity constant, wherein the spectral sensitivities of said light detection devices have characteristics the same as or approximated to the characteristics obtained by multiplying the sum of the real number multiples of luminosity spectral characteristics by the spectral transmittance from said light sources to the display surface and then dividing by the spectral transmittance from said light sources to the positions where said light detection devices are installed.

The method for controlling display colors of a transmission type display device of the present invention can be a method for controlling display colors of a transmission type display device which is provided with plural light sources having different emission colors and which displays color images by making the light emitted from said light sources pass through a color-blending part and controlling the light by an optical shutter, said method comprising the steps of: blending the colors of the light emitted from said light sources, and detecting the colors by at least four light detection devices which are installed in positions closer to said light source than said optical shutter and whose spectral sensitivities have characteristics the same as or approximated to the characteristics obtained by multiplying the sum of the real number multiples of luminosity spectral characteristics by the spectral transmittance from said light sources to the display surface, dividing by the spectral transmittance from said light sources to the positions where said light detection devices are installed, and adding up the result with a real number; a calculation part for subjecting the sensitivity reading values of said light detection devices to linear transformation to change into three values using a matrix of 3 rows and n columns when the number of the light detection devices is set to n; and keeping the display chromaticity constant by controlling the emission intensities of the light sources having different colors so as to keep the three calculation results constant.

The method for controlling display colors of a transmission type display device of the present invention can be a method for controlling display colors of a transmission type display device which is provided with plural light sources having different emission colors and which displays color images by making the light emitted from said light sources pass through a color-blending part and controlling the light by an optical shutter, said method comprising the steps of:

blending colors of the light emitted from said light sources and then detecting the colors with at least three light detection devices installed outside the display region of the display surface side of said optical shutter; converting the detected light into numbers; finding error values from the numerical values and the design values of said light detection devices and then multiplying the gains or losses of the output of the light sources calculated from said light detection devices by the previous output values; and controlling the emission intensities of said light sources having different colors based on said multiplied values so as to keep display chromaticity constant, wherein spectral sensitivities of said light detection devices have characteristics the same as or approximated to the characteristics of the sum of the real number multiples of the luminosity spectral characteristics, and another optical shutter having the same characteristic as the display region of said optical shutter is provided in the positions where said light detection devices are installed.

The method for controlling display colors of a transmission type display device of the present invention can be a method for controlling display colors of a transmission type display device which is provided with plural light sources having different emission colors and which displays color images by making the light emitted from said light sources pass through a color-blending part and controlling the light by an optical shutter, said method comprising the steps of:

blending colors of the light emitted from said light sources and then detecting the colors with at least three light detection devices which are installed on a light path that passes through a small piece of said optical shutter having a similar spectral transmittance to said optical shutter, said light path being provided aside from a light path leading to the display surface by branching a light path which extends from said color-blending part to said optical shutter; converting the detected light into numbers; finding error values from the numerical values and the design values of said light detection devices and then multiplying the gains or losses of the output of the light sources calculated from said light detection devices by the previous output values; and controlling the emission intensities of said light sources having different colors based on said multiplied values so as to keep display chromaticity constant, wherein spectral sensitivities of said light detection devices have characteristics the same as or approximated to the characteristics of the sum of the real number multiples of the luminosity spectral characteristics, and another optical shutter having the same characteristic as the display region of said optical shutter is provided in the positions where said light detection devices are installed.

The method for controlling display colors of a transmission type display device of the present invention can be a method for controlling display colors of a transmission type display device which is provided with plural light sources having different emission colors and which displays color images by making the light emitted from said light sources pass through a color-blending part and controlling the light by an optical shutter, said method comprising the steps of:

blending the colors of the light emitted from said light sources, and detecting the colors by at least four light detection devices which are installed outside the display region of the display surface side of said optical shutter and whose spectral sensitivities have characteristics the same as or approximated to the characteristics obtained by adding a real number to the sum of the real number multiples of luminosity spectral characteristics, said at least four light detection devices having another optical shutter having the same characteristic as the display region of said optical shutter in the position outside the display region where said light detection devices are installed; a calculation part for subjecting the sensitivity reading values of said light detection devices to linear transformation to change into three values using a matrix of 3 rows and n columns when the number of the light detection devices is set to n; and keeping the display chromaticity constant by controlling the emission intensities of the light sources having different colors so as to keep the three calculation results constant.

The method for controlling display colors of a transmission type display device of the present invention can be a method for controlling display colors of a transmission type display device which is provided with plural light sources having different emission colors and which displays color images by making the light emitted from said light sources pass through a color-blending part and controlling the light by an optical shutter, said method comprising the steps of:

blending the colors of the light emitted from said light sources, and detecting the colors by at least four light detection devices which are installed on a light path that passes through a small piece of said optical shutter having a similar spectral transmittance to said optical shutter, said light path being provided aside from a light path leading to the display surface by branching a light path which extends from said color-blending part to said optical shutter, and whose spectral sensitivities have characteristics the same as or approximated to the characteristics obtained by adding a real number to the sum of the real number multiples of luminosity spectral characteristics, said at least four light detection devices having another optical shutter having the same characteristic as the display region of said optical shutter in the position outside the display region where said light detection devices are installed; a calculation part which subjects the sensitivity reading values of said light detection devices to linear transformation to change into three values using a matrix of 3 rows and n columns when the number of the light detection devices is set to n; and keeping the display chromaticity constant by controlling the emission intensities of the light sources having different colors so as to keep the three calculation results constant.

The transmission type display device of the present invention can be a transmission type display device which is provided with a light source; a light detection device whose sensitivity reading values are A/D converted; and a control part which keeps brightness and chromaticity or brightness only constant based on the obtained numerical values, the transmission type display device being characterized by comprising means for changing the reference voltage of AID conversion in proportion to the corresponding dimmer set ratio when the brightness or chromaticity is changed.

The method for controlling display colors of the transmission type display device of the present invention is a method for controlling display colors of the transmission type display device which is provided with a light source and a light detection device, whose sensitivity reading values are A/D converted; and a control part which keeps brightness and chromaticity or brightness only constant based on the obtained numerical values, the transmission type display device being characterized by comprising means for changing the reference voltage of A/D conversion in proportion to the corresponding dimmer set ratio when the brightness or chromaticity is changed.

The method for controlling display colors of the transmission type display device and calibration method of the present invention is a method for controlling transmission type display colors provided with at least four light detection devices, wherein the matrix elements used in the calculation process for subjecting the sensitivity reading values of the light detection devices to linear transformation are obtained by applying the matrix multiplication of the inverse matrix of 4 rows and 4 columns where the same color is arranged in the same column by using the sensitive reading values of the light detection devices as row elements to the matrix of 3 rows and 4 columns where the same color is arranged in the same column by using the luminosity tristimulus values on the display surface which are measured about four different emission colors by changing the emission ratio of the light sources. And at least one of the four emission colors is generated under the different temperature condition of the display device from the others.

The method for controlling display colors of the transmission type display device and calibration method of the present invention is a method for controlling display colors of a transmission type display device which is provided with four light detection devices and light sources having at least four different colors, wherein the matrix elements used in the calculation process for subjecting the sensitivity reading values of the light detection devices to linear transformation are obtained by applying the matrix multiplication of the inverse matrix of 4 rows and 4 columns where the same color is arranged in the same column by using the sensitive reading values of the light detection devices as row elements to the matrix of 3 rows and 4 columns where the same color is arranged in the same column by using the luminosity tristimulus values on the display surface which are measured about four different emission colors by changing the emission ratio of the light sources.

DETAILED DESCRIPTION

The transmission type display device and the method for controlling its display colors according to the present invention will be described as follows, based on the attached drawings.

Embodiment 1

Figure 1:
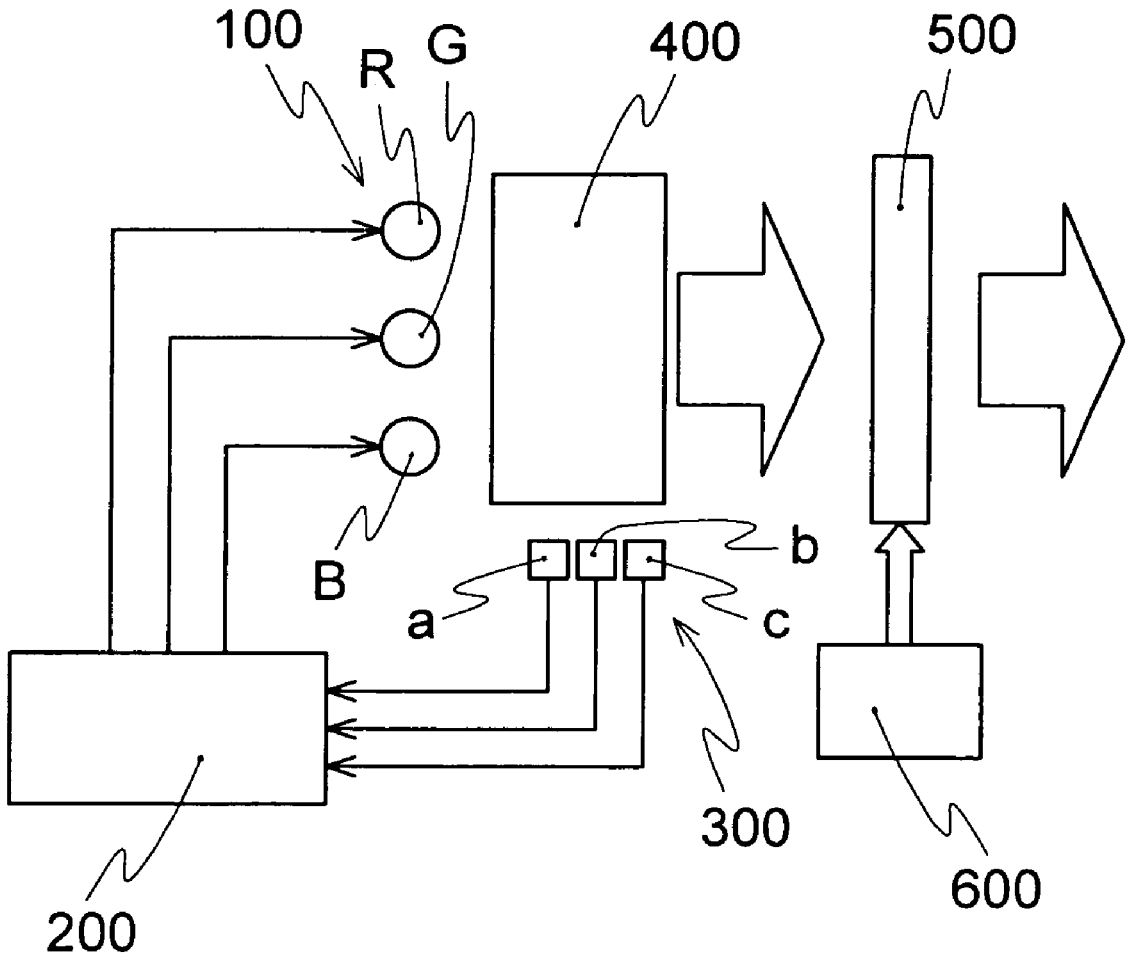
FIG. 1 is a block diagram showing the transmission type display devices of Embodiments 1 and 2 of the present invention.

FIG. 1 is a block diagram showing the transmission type display device of Embodiment 1 of the present invention. As shown in FIG. 1, the transmission type display device of Example 1 of the present invention includes light sources 100 composed of at least three colors. These colors are well blended by a color-blending part 400 and displayed as color images after passing through an optical shutter 500, such as a liquid crystal panel, which is driven by a shutter control circuit 600. The light sources 100 have their color emission intensities (emission ratio) controlled by a light source control circuit 200, with which light detection devices 300 composed of at least three sensors are connected. The light detection devices 300 are installed in the positions where the colors of the light sources are well blended. The three light detection devices 300 can be sensors a, b, and c each of which consists at least of a light-receiving element such as a photo diode or a photo multiplier and a color filter.

The characteristics required for the sensors used in the present invention will be described as follows. In Embodiment 1, the colors used in the light sources are red (R), green (G), and blue (B) to simplify the explanation; however, other color combinations or more than three colors can be used to acquire the function of the present invention.

First, it is necessary for the correct detection of changes in the spectrums of the light sources 100 as color information that the spectral sensitivities of the sensors are equal to the luminosity (spectral) characteristics, that is, the isochromat function of tristimulus values ($x(\lambda)$, $y(\lambda)$, $z(\lambda)$) proposed by CIE1931 (published by International Commission on Illumination).

However, in general, a sensor whose control is approximated to the isochromat function is not easily available and is expensive, so it is difficult to install it in each display device.

Ideally speaking, it is preferable that the sensor be provided on the display surface to detect colors on display. However, the sensor is actually installed inside a display device on the light source sides rather than the shutter side so as not to disturb the actual use of the display device. However, in this case, the visible emission on the display surface is the result of light beams passing through a device such as a shutter or an optical film, and their spectral transmittance characteristics are usually not constant in a visible light wavelength region. This causes a problem that the light colors detected by the sensor are different from the light colors on the display.

Assuming that the tristimulus values of the white temperature, which is recognized as white when displayed, are referred to as X, Y, and Z, and the sensitivity reading values of the sensors a, b, and c having different sensitivity characteristics from each other are referred to as Sa, Sb, and Sc, then X, Y, and Z and Sa, Sb, and Sc are uniquely connected with each other as shown in the formula (1) below. The linear transformation matrix M is ideally a unit matrix, and in that case it has a stable inverse matrix.

$$\begin{pmatrix} X \\ Y \\ Z \end{pmatrix} = M \begin{pmatrix} S_a \\ S_b \\ S_c \end{pmatrix} \tag{1}$$

Hence, (the sensitive reading values of the sensors a, b, and c) however the spectrums of the light sources 100 may change, it becomes possible to keep the color temperature of display images constant by controlling the emission intensities (emission ratio) of the three light sources 100 in a manner that X, Y, and Z on display to be recognized as white.

Assume that the spectrum of light sources 100 to be used is $C(\lambda)$ and that $C(\lambda)$ is the sum of the spectrums of light sources 100 of different colors. Also assume that the spectrum of white displayed on a panel is the light passed through the color-blending part 400 and the optical shutter 500 and that the spectrum of the light reflected on the display surface is D(λ). D(λ) can be expressed as follows:

$$D(\lambda)=k(\lambda)C(\lambda) \tag{2}$$

In the formula (2), k(λ) represents a spectral transmittance of the color-blending part 400 and the optical shutter 500, and the spectral transmittance includes another optical film when it is used. The spectrum S(λ) of the light coming into the sensors a, b, and c is expressed as follows:

$$S(\lambda)=k'(\lambda)C(\lambda) \tag{3}$$

In the formula (3), k'(λ) represents a spectral transmittance of the portion where light passes from the three light sources 100 to the sensors a, b, and c. When C(λ) is deleted from the formulas (2) and (3), the following formula (4) is established.

$$D(\lambda)=\frac{k(\lambda)}{k'(\lambda)}S(\lambda) \tag{4}$$

Here, the following formula is defined:

$$P(\lambda)=k(\lambda)/k'(\lambda) \tag{5}$$

P(λ) can be found by measuring each of the two spectral transmittances k(λ) and K'(λ) by using an arbitrary light source, and mainly depends on the spectral transmittance of the optical shutter 500.

When the spectral sensitivities of the sensors a, b, and c are set to Sa(λ), Sb(λ), and Sc(λ), respectively, the formula (1) can be expressed as follows:

$$\begin{pmatrix} \int x(\lambda)D(\lambda)d(\lambda) \\ \int y(\lambda)D(\lambda)d(\lambda) \\ \int z(\lambda)D(\lambda)d(\lambda) \end{pmatrix} = M \begin{pmatrix} \int S_a(\lambda)S(\lambda)d\lambda \\ \int S_b(\lambda)S(\lambda)d\lambda \\ \int S_c(\lambda)S(\lambda)d\lambda \end{pmatrix} \tag{6}$$

Here, in Embodiment 1, in an attempt to simplify the explanation, the constant to find the absolute value on the lift side is omitted. The integral range on the left side is a visible light wavelength range, and the integral range on the right side is a sensor sensitivity range. When a color filter is laid on a light-receiving element, each of the spectral sensitivities Sa(λ), Sb(λ), and Sc(λ) of the sensors a, b, and c becomes the product of the spectral sensitivity characteristics of the light-receiving element and the spectral transmittance of the color filter. The inverse matrix $M^{-1}$ of the matrix M is defined in the following formula (7).

$$M^{-1}=\begin{pmatrix} a_x & a_y & a_z \\ b_x & b_y & b_z \\ c_x & c_y & c_z \end{pmatrix} \tag{7}$$

Consequently, the formula (6) is turned into the following formula (8):

$$\begin{pmatrix} \int S_a(\lambda)S(\lambda)d\lambda \\ \int S_b(\lambda)S(\lambda)d\lambda \\ \int S_c(\lambda)S(\lambda)d\lambda \end{pmatrix} = \begin{pmatrix} a_x\int x(\lambda)D(\lambda)d\lambda + a_y\int y(\lambda)D(\lambda)d\lambda + a_z\int z(\lambda)D(\lambda)d\lambda \\ b_x\int x(\lambda)D(\lambda)d\lambda + b_y\int y(\lambda)D(\lambda)d\lambda + b_z\int z(\lambda)D(\lambda)d\lambda \\ c_x\int x(\lambda)D(\lambda)d\lambda + c_y\int y(\lambda)D(\lambda)d\lambda + c_z\int z(\lambda)D(\lambda)d\lambda \end{pmatrix} \tag{8}$$

The formulas (4) and (5) can be substituted into the formula (8) to obtain the following formula (9):

$$\begin{pmatrix} \int S_a(\lambda)S(\lambda)d\lambda \\ \int S_b(\lambda)S(\lambda)d\lambda \\ \int S_c(\lambda)S(\lambda)d\lambda \end{pmatrix} = \begin{pmatrix} a_x\int x(\lambda)P(\lambda)S(\lambda)d\lambda + a_y\int y(\lambda)P(\lambda)S(\lambda)d\lambda + a_z\int z(\lambda)P(\lambda)S(\lambda)d\lambda \\ b_x\int x(\lambda)P(\lambda)S(\lambda)d\lambda + b_y\int y(\lambda)P(\lambda)S(\lambda)d\lambda + b_z\int z(\lambda)P(\lambda)S(\lambda)d\lambda \\ c_x\int x(\lambda)P(\lambda)S(\lambda)d\lambda + c_y\int y(\lambda)P(\lambda)S(\lambda)d\lambda + c_z\int z(\lambda)P(\lambda)S(\lambda)d\lambda \end{pmatrix} \tag{9}$$

When the spectral sensitivities of the sensors a, b, and c are 0 outside the visible light wavelength range or when the spectrums of the light sources are not present other than the visible light, the integral ranges become equal. Comparison between the right side and left side of the formula (9) indicates that the following formula (10) is a possible requirement to establish the formula (9) regardless of the value of S(λ).

$$S_a(\lambda)=\{a_x x(\lambda)+a_y y(\lambda)+a_z z(\lambda)\}P(\lambda)$$

$$S_b(\lambda)=\{b_x x(\lambda)+b_y y(\lambda)+b_z z(\lambda)\}P(\lambda)$$

$$S_c(\lambda)=\{c_x x(\lambda)+c_y y(\lambda)+c_z z(\lambda)\}P(\lambda) \tag{10}$$

These are the requirements required for the spectral sensitivities Sa(λ), Sb(λ), and Sc(λ) of the three sensors a, b, and c.

As apparent from the formulas (10), the spectral sensitivities Sa(λ), Sb(λ), and Sc(λ) of the three sensors a, b, and c correspond to the results obtained when the sum of the constant multiples of the three luminosity (spectral) characteristics (isochromat function: x(λ), y(λ), and z(λ)) is multiplied by the spectral transmittance k(λ) from the light sources 100 to the display surface, and is divided by the spectral transmittance k'(λ) from the light sources 100 to the positions where the sensors a, b, and c are installed in accordance with the respective terms of $P(\lambda)=k(\lambda)/k'(\lambda)$. The aforementioned constants are so selected that when the constants are a matrix of 3 rows and 3 columns, the matrix has an inverse matrix.

It must be noted that when $k'(\lambda)$ is different from position to position because the sensors a, b, and c are installed apart from each other or because of other reasons, that is, when the color blending of the color-blending part 400 is dependent on position and when light having different spectrums comes into the sensors a, b, and c, $P(\lambda)$ is different from sensor to sensor. If for this reason, the difference in $P(\lambda)$ among the sensors a, b, and c is larger than the intended control precision of the emission intensity, it is preferable to calculate or measure $P(\lambda)$ in respect to the position to install each of the sensors a, b, and c, and to use the obtained results.

The formulas (10) indicate that the constant of the inverse matrix $M^{-1}$ shown in the formula (7) can be selected arbitrarily. This makes it unnecessary to approximate the spectral sensitivities $Sa(\lambda)$, $Sb(\lambda)$, and $Sc(\lambda)$ of the sensors a, b, and c strictly to the luminosity (spectral) characteristics $x(\lambda)$, $y(\lambda)$, and $z(\lambda)$, thereby enabling the spectral characteristics of the sensors and the optical shutter to be produced in a wide range freely. Furthermore, if the sensors a, b, and c are installed on the display surface side or when $P(\lambda)$ is constant or changes as small as can be ignored due to wavelength, then the spectral sensitivities $Sa(\lambda)$, $Sb(\lambda)$, and $Sc(\lambda)$ of the sensors a, b, and c can merely be the sum of the constant multiples of the luminosity (spectral) characteristics $x(\lambda)$, $y(\lambda)$, and $z(\lambda)$, which facilitates the production.

These sensors a, b, and c can actually be a combination of the aforementioned light-receiving element such as a photo diode or a photo multiplier and a color glass filter, a deposition interference filter, or a less expensive synthetic color filter so that the characteristics meet the formulas (10).

In designing the characteristics of the light detection devices 300 or the sensors, when the sensors are used in combination with an existing filter, the design which makes the product of the spectral transmittances satisfy the formulas (10) can be found easily and uniquely by a least squares method because the coefficients of the formulas (10) are a linear combination. The function of the formulas (10) using the obtained coefficients can be compared with the spectral sensitivity characteristics (hereinafter referred to as sensor characteristics) of the light detection devices combined with the actual filter to select the one with the less deviation.

When a filter is newly designed, realizable sensor characteristics are predicted to find the coefficients of the formulas (10) in the same manner, and the predicted sensor characteristics are compared with the formulas (10) and the coefficients are recalculated, which is repeated to reach the required precision.

When the light sources 100 to be used have a limited range of spectrums such as an LED, the range of the wavelength region having a spectrum can be exclusively applied to the formulas (10).

Figure 2A:
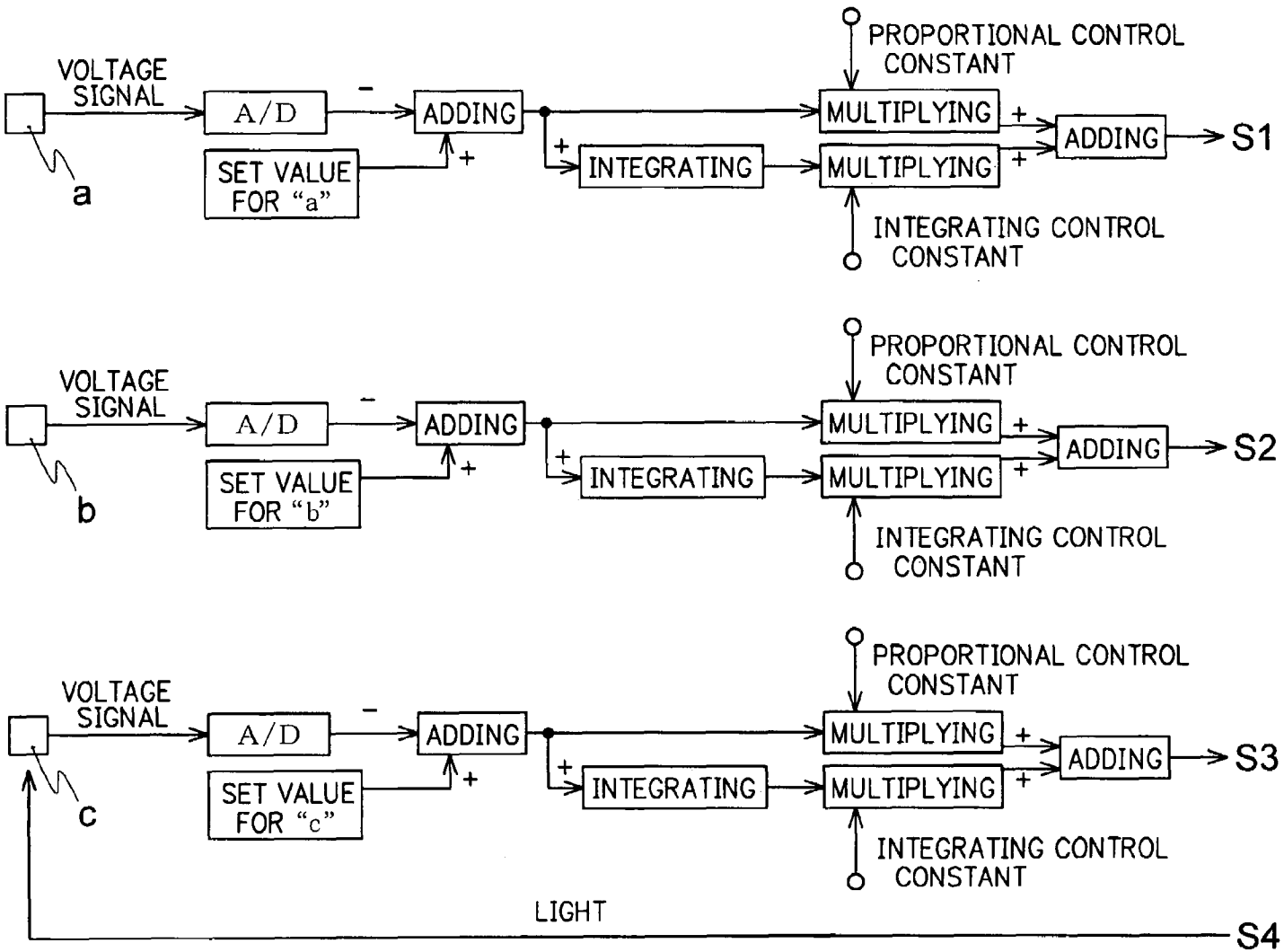
FIGS. 2A and 2B are block diagrams which explain a method for controlling light sources shown in FIG. 1.
Figure 2B:
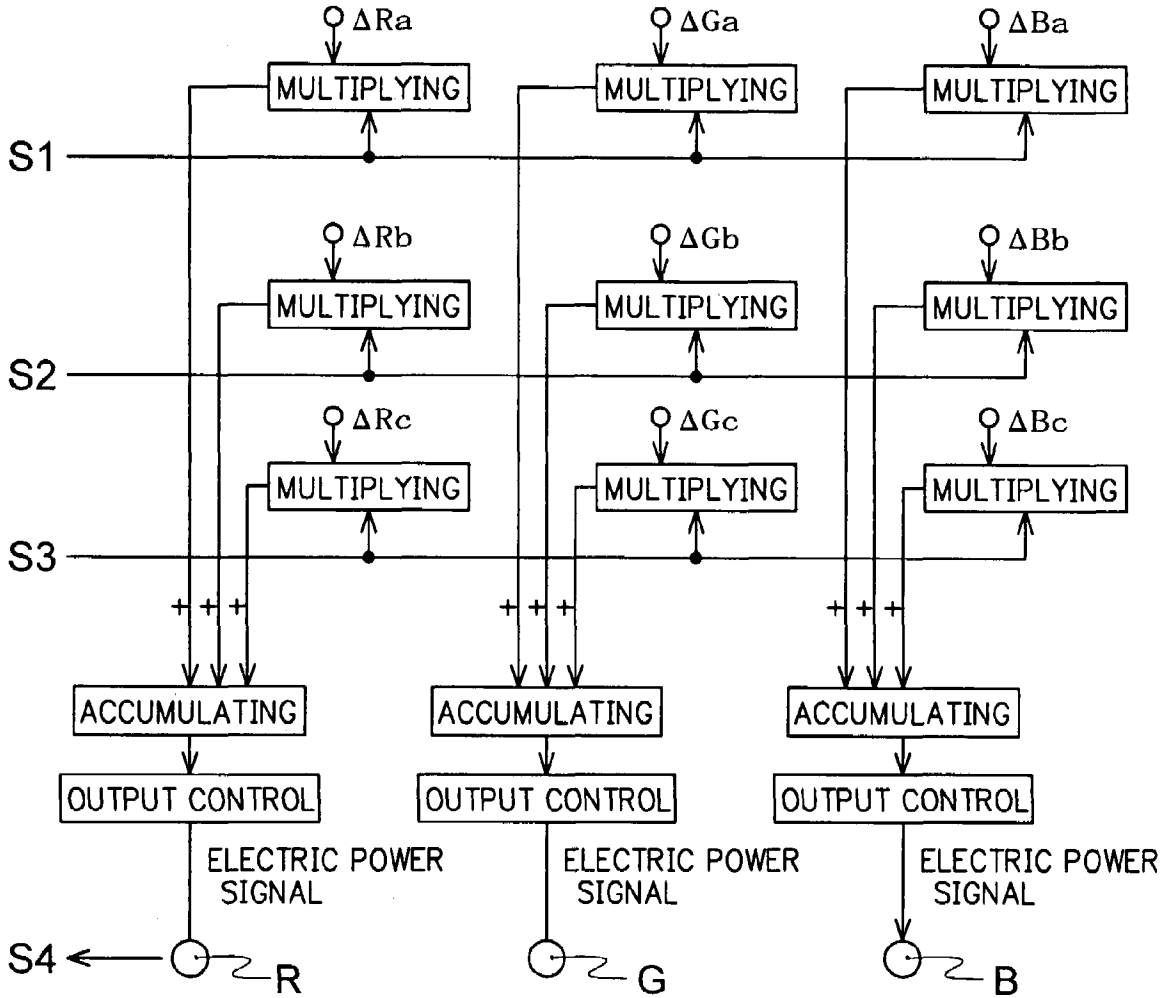

The following is a description of a method for controlling display colors of the transmission type display device of the present invention. FIGS. 2A and 2B are block diagrams of the light source control circuit in the transmission type display device of the present invention. In FIGS. 2A and 2B, arrows without special mention indicate exchanges of numerical values. The light beams emitted from the three light sources R, G, and B are blended and detected by the sensors a, b and c. When the sensors a, b, and c are light-current conversion elements, current-voltage conversion is performed and the voltage values are entered to the respective A/D converters to be turned into numerical values. The numerical values are hereinafter referred to as sensor reading values. The sensor reading values are subtracted from the set values of the sensors a, b, and c, and the error values are calculated. The error values are entered to proportional control and integral control, and the integral control constants and the proportional control constants are multiplied respectively and added. Then, each of the calculation values of the sensors a, b, and c thus added is subjected to linear transformation by the modified differential multiplier matrix given by the following formula (11), thereby transforming into the gains and losses of the output values of the light sources R, G, and B.

$$\begin{pmatrix} \Delta R_a & \Delta G_a & \Delta B_a \\ \Delta R_b & \Delta G_b & \Delta B_b \\ \Delta R_c & \Delta G_c & \Delta B_b \end{pmatrix} = \begin{pmatrix} \frac{\partial I_R}{\partial S_a} & \frac{\partial I_G}{\partial S_a} & \frac{\partial I_B}{\partial S_a} \\ \frac{\partial I_R}{\partial S_b} & \frac{\partial I_G}{\partial S_b} & \frac{\partial I_B}{\partial S_b} \\ \frac{\partial I_R}{\partial S_c} & \frac{\partial I_G}{\partial S_c} & \frac{\partial I_B}{\partial S_c} \end{pmatrix} \tag{11}$$

In the formula (11), $I_R$, $I_G$ and $I_B$ are values for setting the emission intensities of the light sources R, G, and B, respectively. The gains and losses of the outputs of the light sources R, G, and B calculated by the sensors a, b, and c are multiplied by the previously outputted output values of the light sources R, G, and B and entered to the output control circuit. The output control circuit adjusts electric power to be outputted by the mode (physical amount) used to control the emission intensities of the light sources, such as voltage, current, or pulse width modulation, so as to adjust the emission amounts of the light sources R, G, and B. The outputted light is entered again into the sensors a, b, and c, and the same control is repeated to keep the display intensity and chromaticity at desired values.

When the emission intensities of the light sources R, G, and B to be used are linear in respect to the output values entered to the output circuit, the matrix elements in the formula (11) are as follows:

$$\begin{pmatrix} I_R \\ I_G \\ I_B \end{pmatrix} = \begin{pmatrix} \frac{\partial I_R}{\partial S_a} & \frac{\partial I_G}{\partial S_a} & \frac{\partial I_B}{\partial S_a} \\ \frac{\partial I_R}{\partial S_b} & \frac{\partial I_G}{\partial S_b} & \frac{\partial I_B}{\partial S_b} \\ \frac{\partial I_R}{\partial S_c} & \frac{\partial I_G}{\partial S_c} & \frac{\partial I_B}{\partial S_c} \end{pmatrix} \begin{pmatrix} S_a \\ S_b \\ S_c \end{pmatrix} \tag{12}$$

This enables the respective outputs of arbitrary three different light sources R, G, and B to be read by the sensors a, b, and c, and subjected to matrix calculation, thereby finding the output order values $I_R$, $I_G$, and $I_B$. As one of the simplest examples, an inverse of the matrix of which column elements correspond to the sensor values in the case where the light source R only is on, in the case where the light source G only is on, and the light source B only is on becomes the elements of the matrix of the formula (11).

If the spectrums of the light sources 100 to be used do not change largely while the display device is being used, then the matrix elements of the formula (11) can be used as a constant without affecting the results. However, when the spectrums fluctuate largely or must be controlled with extremely high precision, the matrix elements can be amended by proper calibration. In a control loop of more than two times, when the values of $I_R$, $I_G$, and $I_B$ are three different kinds and when the determinant of the matrix consisting of 3 rows and 3 columns having the sensor reading values at that time as column elements is not zero, the inverse matrix of the matrix can be found to provide the formula (12) with three independent requirements, thereby enabling the finding of the matrix elements of the formula (11) in real time.

In an attempt to find the respective sensor set values of the sensors a, b, and c shown in FIGS. 2A and 2B from the intended brightness and chromaticity, the XYZ values of arbitrary three different colors are measured from the display surface by using an external spectral chromaticity meter, and the sensor reading values at that moment are also recorded. As a result, the elements of the matrix M can be found from the formula (1) and its invert matrix can be used to determine the sensor set values through invert transformation of the formula (1).

Figure 3:
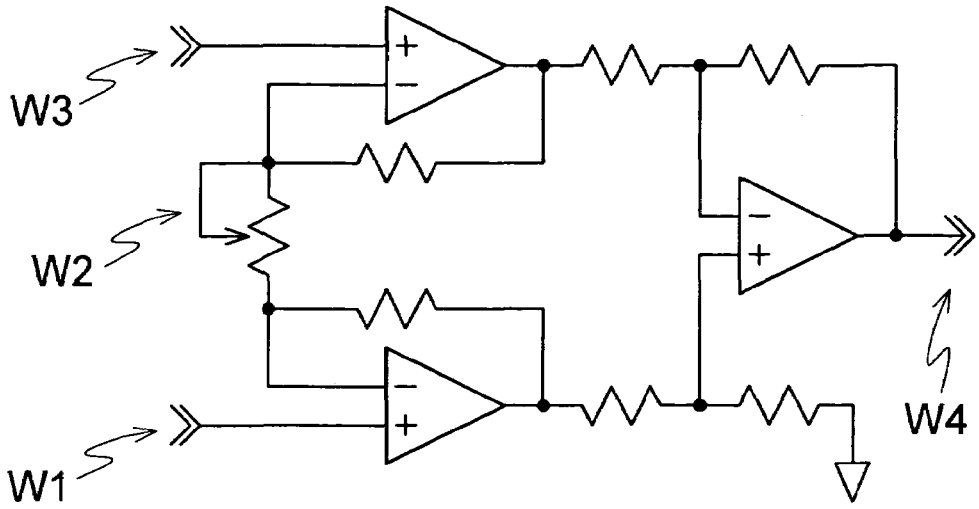
FIG. 3 is a circuit example which improves the precision of the A/D converter used in the present invention, based on offset voltage W1, gain W2 and sensor voltage signal W3.

In the present embodiment, if the elements of the first row of the formula (7) are (0.5, 0.5, 0), the sensor "a" detects both X and Y out of the tristimulus values. This means that the sensitivity of the sensor "a" is reduced to nearly half with respect to X, which leads to a decrease in the precision. To solve this problem, the circuit shown in FIG. 3 is used to properly adjust the offset voltage W1 and the gain W2. In FIG. 3, W3 and W4 represent the voltage from the sensor and the voltage signal to the A/D converter, respectively.

In the display device used in the present invention, it is advantageous that the user is free to change the chromaticity (white temperature) and brightness as desired. The chromaticity can be changed by changing the ratio of the set values between the sensors a, b, and c. The brightness can be changed by proportionally multiplying the entire set values of the sensors a, b, and c by a coefficient.

However, it causes a problem when this is done digitally. Assume that A/D conversion has a resolution of 100. In the case where the value after A/D conversion at the highest brightness is set to around 100, when 10% of brightness is desired, the value after A/D conversion becomes 10 or so, which means that the original resolution setting of 1/100 decreases to 1/10. In this condition, the ratio of the sensors a, b, and c for white temperature setting becomes in unit of 10%, making colors to be set discrete.

Figure 4:
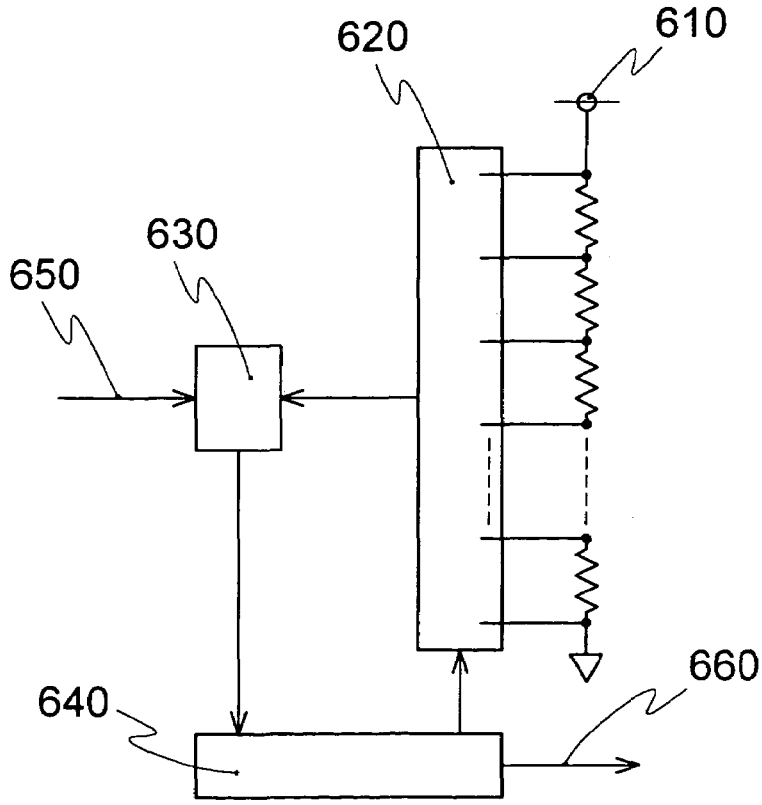
FIG. 4 is an illustration showing the circuit configuration of analog/digital (A/D) conversion.

The following is a measure for solving this problem. In general, the circuit configuration of A/D conversion is as shown in FIG. 4. When it is desired to set the brightness to 10%, the A/D reference voltage (input terminal 610) corresponding to the full-scale voltage of A/D conversion can be set to 10% of the highest brightness. This enables the set values of the sensors to be kept at the original resolution of 100 at the highest brightness and the brightness to be set to 10% automatically. As the measure to dynamically change the reference voltage, when a microcomputer capable of PWM output is used for control, it is possible to pass an integral circuit through the PWM output, or to use a semiconductor device which changes resistance values by digital values. In FIG. 4, the numeral 620 represents a select, 630 a comparator, 640 an A/D controller, 650 a sensor input, and 660 an A/D conversion value.

The same holds true for changes in chromaticity as well as brightness. For example, when the ratio of the sensors a, b, and c is 100%, 100%, and 50%, respectively, only the sensor "c" has a low resolution of control. Therefore, in the A/D conversion of the sensor "c", the appropriate A/D reference voltage can be made 50% to obtain the same level of resolution as the other sensors. When it is also desired to set the brightness to 10% in that condition, the A/D reference voltages corresponding to the A/D conversions of the sensors a, b, and c can be set to 10%, 10%, and 5%, respectively.

In the present embodiment, as shown in the formulas (10), the sensitivity design of the sensors can be done with an extremely wide flexibility without strictly adjusting the spectral sensitivities Sa(λ), Sb(λ), and Sc(λ) of the sensors to the luminosity (spectral) characteristics x(λ), y(λ), and z(λ). This means that an inexpensive synthetic resin filter can be used, thereby reducing the cost of the display device. In the present embodiment, the difference between the colors displayed and the colors coming into the positions where the sensors are installed is taken into consideration so as to realize high precision control.

Embodiment 2

Embodiment 1 has clarified the requirements required for the sensors to achieve high precision control and described a method for designing the sensors with large flexibilities because the requirements have large flexibilities. The present embodiment will explain a method for further expanding the sensor characteristics expressed by the formulas (10).

The formulas (10) indicate that the constant related to the luminosity (spectral) characteristics in each equation, that is, the matrix elements of the formula (7) can be mathematically any number as long as it has an inverse matrix. Therefore, this element can be a negative value. However, the sensor characteristics of the formulas (10) may have a numerically negative region depending on the negative value. Since the actual sensor characteristics always have positive values, such characteristics do not match the actual sensor characteristics.

Therefore, concerning four sensors a, b, c, and d, sensor characteristics Sa(λ), Sb(λ), Sc(λ), and Sd(λ) are defined as the following formulas (13) by using arbitrary offset parameters $a_c$, $b_c$, $c_c$, and $d_c$ as in the formulas (10).

$$S_a(\lambda)=\{a_x x(\lambda)+a_y y(\lambda)+a_z z(\lambda)\}P(\lambda)+a_c$$

$$S_b(\lambda)=\{b_x x(\lambda)+b_y y(\lambda)+b_z z(\lambda)\}P(\lambda)+b_c$$

$$S_c(\lambda)=\{c_x x(\lambda)+c_y y(\lambda)+c_z z(\lambda)\}P(\lambda)+c_c$$

$$S_d(\lambda)=\{d_x x(\lambda)+d_y y(\lambda)+d_z z(\lambda)\}P(\lambda)+d_c \tag{13}$$

Sensors with such characteristics can have positive values in the region of all wavelengths of the sensor sensitivities or in the region where the light source spectrums are present, by the offset parameter, even when the coefficients relative to the luminosity (spectral) characteristics are set to negative values in the respective sensor sensitivities. In short, the sensors can be selected or designed in a much wider range than in Embodiment 1. This allows the use of inexpensive sensors and color filters, thereby reducing the total cost of the display device.

The following is a description of the actual control when sensors having such characteristics are used. With the use of the formulas (13), $S'_a(\lambda)$, $S'_b(\lambda)$, and $S'_c(\lambda)$ are calculated as the following formulas (14).

$$S'_a(\lambda)=\frac{S_a(\lambda)}{a_c}-\frac{S_d(\lambda)}{d_c}=\left\{\left(\frac{a_x}{a_c}-\frac{d_x}{d_c}\right)x(\lambda)+\left(\frac{a_y}{a_c}-\frac{d_y}{d_c}\right)y(\lambda)+\left(\frac{a_z}{a_c}-\frac{d_z}{d_c}\right)z(\lambda)\right\}P(\lambda) \tag{14}$$

$$S'_b(\lambda)=\frac{S_b(\lambda)}{b_c}-\frac{S_d(\lambda)}{d_c}=\left\{\left(\frac{b_x}{b_c}-\frac{d_x}{d_c}\right)x(\lambda)+\left(\frac{b_y}{b_c}-\frac{d_y}{d_c}\right)y(\lambda)+\left(\frac{b_z}{b_c}-\frac{d_z}{d_c}\right)z(\lambda)\right\}P(\lambda)$$

$$S'_c(\lambda)=\frac{S_c(\lambda)}{c_c}-\frac{S_d(\lambda)}{d_c}=\left\{\left(\frac{c_x}{c_c}-\frac{d_x}{d_c}\right)x(\lambda)+\left(\frac{c_y}{c_c}-\frac{d_y}{d_c}\right)y(\lambda)+\right.$$

-continued $$\left(\frac{c_z}{c_c}-\frac{d_z}{d_c}\right)z(\lambda)\Big\}P(\lambda)$$

According to the following formulas (15):

$$\left(\frac{a_x}{a_c}-\frac{d_x}{d_c}\right)=a'_x,\ \left(\frac{a_y}{a_c}-\frac{d_y}{d_c}\right)=a'_y,\ \left(\frac{a_z}{a_c}-\frac{d_z}{d_c}\right)=a'_z,$$
$$\left(\frac{b_x}{b_c}-\frac{d_x}{d_c}\right)=b'_x,\ \left(\frac{b_y}{b_c}-\frac{d_y}{d_c}\right)=b'_y,\ \left(\frac{b_z}{b_c}-\frac{d_z}{d_c}\right)=b'_z,$$
$$\left(\frac{c_x}{c_c}-\frac{d_x}{d_c}\right)=c'_x,\ \left(\frac{c_y}{c_c}-\frac{d_y}{d_c}\right)=c'_y,\ \left(\frac{c_z}{c_c}-\frac{d_z}{d_c}\right)=c'_z \tag{15}$$

the formulas (14) become substantially the same as the formulas (15). Therefore, in the present embodiment, four sensor reading values which have the formulas (13) or are approximated to the formulas (13) are divided by the offset parameter according to the formulas (14), and the values calculated by the fourth sensor are subtracted therefrom to obtain the relation shown in the formulas (10). After that, the correction values $S'_a$, $S'_b$, and $S'_c$ of the sensor reading values found by the calculation of the formulas (14) are controlled as the sensor reading values explained in Embodiment 1 so as to keep the colors of the display images constant. In the block diagram of FIGS. 2A and 2B, all that must be done is to use the correction values $S'_a$, $S'_b$, and $S'_c$ as the numerical values obtained by subjecting each sensor voltage to A/D conversion, and the subsequent control is the same as in Embodiment 1.

In the present embodiment, four sensors are used, and the sensor reading values of the three sensors a, b, and c are corrected by the sensor reading value of the sensor "d". However, it is also possible to use the reading value of any sensor to correct any other sensor; for example, the sensor "a" can be corrected by the sensor "b". The target of calculation can be determined by considering the deviation of the correction values from the formulas (10) and the quantization error on calculation. However, each coefficient in the formulas (15) must be selected so as not to make the determinant zero (having an inverse matrix) when the coefficient is a matrix element consisting of 3 rows and 3 columns.

In selecting or designing a sensor whose offset parameter is 0 or extremely small, the calculation of the formulas (14) is impossible. However, this sensor requires no such calculation because the sensor itself meets the formulas (10) and can be used as the correction values of the sensor reading values without any change.

With a more general expression, the formulas (14) can be expressed in the following formula (16):

$$\begin{pmatrix} S'_a(\lambda) \\ S'_b(\lambda) \\ S'_c(\lambda) \end{pmatrix} = \begin{pmatrix} \frac{1}{a_c} & 0 & 0 & \frac{1}{d_c} \\ 0 & \frac{1}{b_c} & 0 & \frac{1}{d_c} \\ 0 & 0 & \frac{1}{c_c} & \frac{1}{d_c} \end{pmatrix} \begin{pmatrix} S_a(\lambda) \\ S_b(\lambda) \\ S_c(\lambda) \\ S_d(\lambda) \end{pmatrix} = S' \begin{pmatrix} S_a(\lambda) \\ S_b(\lambda) \\ S_c(\lambda) \\ S_d(\lambda) \end{pmatrix} \tag{16}$$

Therefore, when the number of four or more sensors is n, linear transformation can be applied to the matrix S' consisting of 3 rows and n columns. However, the value of each row of the transformation matrix must be so selected that when the value of the offset parameter of the sensor characteristics that are transformed respectively is exclusively transformed, the result becomes 0. Mathematically, the setting can be done to meet the following formula (17):

$$\begin{pmatrix} 0 \\ 0 \\ 0 \end{pmatrix} = S' \begin{pmatrix} a_c \\ b_c \\ c_c \\ d_c \end{pmatrix} \tag{17}$$

In the process for linear transformation with the matrix of 3 rows and n columns, in an attempt to simplify the process, it is unnecessary to calculate the section where the element of S' is 0 or extremely small.

In selecting and designing actual sensors, since the formulas (13) are a linear expression concerning each coefficient, it is possible to uniquely determine the parameter suitable to the sensor characteristics actually used by a least squares method. When the spectrum region is limited to a certain range, such as an LED, a weight function can be used for calculation.

In the present embodiment, each parameter can be found by the calculation of sensor characteristics; however, in actual products, it is better to be found through measurement while considering variation in individual products. The formulas (13) can be expressed in the following matrix (18):

$$\begin{pmatrix} S_a \\ S_b \\ S_c \\ S_d \end{pmatrix} = \begin{pmatrix} a_x & a_y & a_z & a_c \\ b_x & b_y & b_z & b_c \\ c_x & c_y & c_z & c_c \\ d_x & d_y & d_z & d_c \end{pmatrix} \begin{pmatrix} PX \\ PY \\ PZ \\ 1 \end{pmatrix} \tag{18}$$

Therefore, XYZ values and sensor reading values at the time of displaying arbitrary four different colors can be recorded to determine each coefficient by solving the equation of the formula (18).

The present embodiment has shown a general method for correcting any or all of the three sensors by providing one correction sensor to the three sensors of Embodiment 1 and using the fourth sensor as a correction sensor.

When the general correction method of the present embodiment is considered about a pair of a correction sensor and a correction target sensor, in the pair sensors, the constant multiples of the respective sensitivity reading values are added up and calculated as the sensitivity reading value of the corrected sensor, and the sensitivity reading value of the sensor which does not need correction is used without adding change. Similar to Embodiment 1, the detection of the tristimulus values by the sensors or a decrease in the precision of the A/D converters due to the large size of the offset parameter can be solved by properly adjusting the offset voltages and gains with the use of the circuit as shown in FIG. 3.

In the present embodiment, the calculation of the formula (16) is done by using numerical values after A/D conversion. Instead of this, the calculation can be done by using analog values by disposing a differential amplifier after an amplifier for constant multiples.

Furthermore, a decrease in the precision of A/D conversion due to changes in dimmer or chromaticity can be solved by changing the reference voltage of A/D conversion in the same manner as in Embodiment 1.

The present embodiment has the effects of greatly easing the requirements required for the sensors and reducing the cost of the display device and expanding the flexibility of the sensor design, while keeping the precision in keeping colors.

Embodiment 3

Embodiment 2 has described a method for controlling four or more sensors having the characteristics of the formulas (13). The following is a description about another method for controlling four sensors.

The formulas (13) can be expressed in the following matrix (19):

$$\begin{pmatrix} S_a(\lambda) \\ S_b(\lambda) \\ S_c(\lambda) \\ S_d(\lambda) \end{pmatrix} = \begin{pmatrix} a_x & a_y & a_z & a_c \\ b_x & b_y & b_z & b_c \\ c_x & c_y & c_z & c_c \\ d_x & d_y & d_z & d_c \end{pmatrix} \begin{pmatrix} x(\lambda)P(\lambda) \\ y(\lambda)P(\lambda) \\ z(\lambda)P(\lambda) \\ 1 \end{pmatrix} \tag{19}$$

If both sides is multiplied by the spectrum $S(\lambda)$ of the light incident to the sensors of the formula (3), then the left side becomes the sensitivity reading values ($S_a$, $S_b$, $S_c$, $S_d$) of the sensors, and the right side becomes the tristimulus values ($X_D$, $Y_D$, $Z_D$) of the light going out to the display surface through the shutter part from the relation of the formula (4), so the formulas (13) can be changed into the following formula (20):

$$\begin{pmatrix} S_a \\ S_b \\ S_c \\ S_d \end{pmatrix} = \begin{pmatrix} a_x & a_y & a_z & a_c \\ b_x & b_y & b_z & b_c \\ c_x & c_y & c_z & c_c \\ d_x & d_y & d_z & d_c \end{pmatrix} \begin{pmatrix} X_D \\ Y_D \\ Z_D \\ 1 \end{pmatrix} \tag{20}$$

If sensors are so selected that the linear transformation matrix of the formula (20) has an inverse matrix, inverse transformation results in the following formula (21):

$$\begin{pmatrix} X_D \\ Y_D \\ Z_D \\ 1 \end{pmatrix} = \begin{pmatrix} X_a & X_b & X_c & X_d \\ Y_a & Y_b & Y_c & Y_d \\ Z_a & Z_b & Z_c & Z_d \\ C_a & C_b & C_c & C_d \end{pmatrix} \begin{pmatrix} S_a \\ S_b \\ S_c \\ S_d \end{pmatrix} \tag{21}$$

Eliminating ineffective elements results in the following formula (22):

$$\begin{pmatrix} X_D \\ Y_D \\ Z_D \end{pmatrix} = \begin{pmatrix} X_a & X_b & X_c & X_d \\ Y_a & Y_b & Y_c & Y_d \\ Z_a & Z_b & Z_c & Z_d \end{pmatrix} \begin{pmatrix} S_a \\ S_b \\ S_c \\ S_d \end{pmatrix} \tag{22}$$

In Embodiment 2, the transformation matrix in the formula (19) is found from the sensor characteristics by means of calculation. When the sensor characteristics are greatly different from each other, it is necessary to measure each sensor characteristic and find the transformation matrix. However, when there are four sensors, the transformation matrix can be found from a simple measurement, thereby eliminating the influence of variation among individuals.

Since the left side of the formula (21) is a value measurable by a standard chromaticity meter through a shutter, if $X_D$, $Y_D$, and $Z_D$ and four sensor reading values of arbitrary different four colors (1, 2, 3, 4) are recorded, then the formula (22) becomes:

$$\begin{pmatrix} X_{D1} & X_{D2} & X_{D3} & X_{D4} \\ Y_{D1} & Y_{D2} & Y_{D3} & Y_{D4} \\ Z_{D1} & Z_{D2} & Z_{D3} & Z_{D4} \end{pmatrix} = \begin{pmatrix} X_a & X_b & X_c & X_d \\ Y_a & Y_b & Y_c & Y_d \\ Z_a & Z_b & Z_c & Z_d \end{pmatrix} \begin{pmatrix} S_{a1} & S_{a2} & S_{a3} & S_{a4} \\ S_{b1} & S_{b2} & S_{b3} & S_{b4} \\ S_{c1} & S_{c2} & S_{c3} & S_{c4} \\ S_{d1} & S_{d2} & S_{d3} & S_{d4} \end{pmatrix} \tag{23}$$

that is, $$\begin{pmatrix} X_a & X_b & X_c & X_d \\ Y_a & Y_b & Y_c & Y_d \\ Z_a & Z_b & Z_c & Z_d \end{pmatrix} = \begin{pmatrix} X_{D1} & X_{D2} & X_{D3} & X_{D4} \\ Y_{D1} & Y_{D2} & Y_{D3} & Y_{D4} \\ Z_{D1} & Z_{D2} & Z_{D3} & Z_{D4} \end{pmatrix} \begin{pmatrix} S_{a1} & S_{a2} & S_{a3} & S_{a4} \\ S_{b1} & S_{b2} & S_{b3} & S_{b4} \\ S_{c1} & S_{c2} & S_{c3} & S_{c4} \\ S_{d1} & S_{d2} & S_{d3} & S_{d4} \end{pmatrix}^{-1}$$

This makes it possible to obtain a transformation matrix from the sensor reading values to the XYZ values of the light which has passed through the shutter.

The arbitrary four colors referred to in this case indicate colors which can be created by changing the emission ratio of the light sources while the shutter part is fixed at white display. When the light sources have three colors, the transformation of the formula (22) mathematically requires the use of at least one color having a changed light source spectrum out of the four arbitrary different colors. For example, when the light sources consist of red, green, and blue and their emission intensities are ($I_R$, $I_G$, $I_B$), as the first to third colors, ($I_R$, $I_G$, $I_B$)=(1, 0, 0), (0, 1, 0), and (0, 0, 1) can be used in the condition that the temperatures are low immediately after illumination, and as the fourth color, ($I_R$, $I_G$, $I_B$)=(1, 1, 1) can be measured when the temperature is raised after some aging. In regard with the three-color light sources, when five red light sources are used and have individual difference in color, the number of colors is not regarded as five, and the same colors are deleted from the total number of colors which controls the emission intensities of the light sources independently. For example, even when red, green, and blue each have five light sources and have individual difference in color, if the number of colors to be controlled is three of red, green, and blue, it is regarded as three colors.

The calibration method using the measurement values after aging not only establishes the formula (22) but also has the effect of realizing parameter setting including the change in the shutter part with temperature because of the use of the measurement values before and after the temperature change even when the spectral transmittance characteristics of the shutter part change with temperature. Although it is not possible to control the temperature change in the shutter part in all the temperature range, at least in the temperature condition and emission intensities used in calibration, the values obtained by applying linear transformation to the sensor reading values by the formula (21) become equal to the actual XYZ values measured through the shutter. Consequently, when the temperature range to use the display device is between 0° C. and 50° C., if the calibration is performed at 0° C. and 50° C., the intended display colors and the actual display colors may be different from each other due to the temperature characteristics of the sensors in the intermediate temperature range; however, the color difference generally forms an upward or downward curve with temperature on the horizontal axis, thereby reducing the size of the maximum deviation.

Since the transformation matrix of the formula (21) has been found by calibration, all that has to be done for the control is to subject the sensitivity reading values of the four sensors to linear transformation through the formula (21) and to keep the values of the top 3 rows after transformation constant in the same manner as Embodiment 1. In other words, the calculation of linear transformation can be done with 3 rows and 4 columns of the top three rows of the transformation matrix of the formula (21). In this system, the values after transformation directly become the tristimulus values of the display colors, so the tristimulus values can be set to the sensor set values. It goes without saying that in Embodiments 1 and 2, it is possible to calculate the sensor set values from the tristimulus values and vice versa.

When four or more different colors of light sources are provided by using four sensors, the matrix elements in the formula (23) can be calculated without using the values after aging. It is of course possible to provide parameter setting which absorbs the influence of temperature change by using the values after aging.

The present embodiment, which has the same sensor requirements as Embodiment 2, has the effect of facilitating the design and selection of the sensors and the production of them at low cost, and also the effect of keeping display colors in high precision and reducing the influence of the temperature characteristics of the shutter part and the sensors by calibration.

Embodiment 4

Embodiments 1 and 2 have been explained on the recondition that the optical shutter has a spectral transmittance which is not constant and the optical shutter does not change with temperature or time. Embodiment 3 has explained a method for reducing the influence of temperature change. However, most optical shutters change with temperature or time. For example, when it is only temperature that changes and the way of changing is known in advance, temperature can be monitored to correct light source colors by an appropriate function or a lookup table. However, in general, there are cases where control is not easy because the change is complicated or there is a large variation among individuals.

Figure 5:
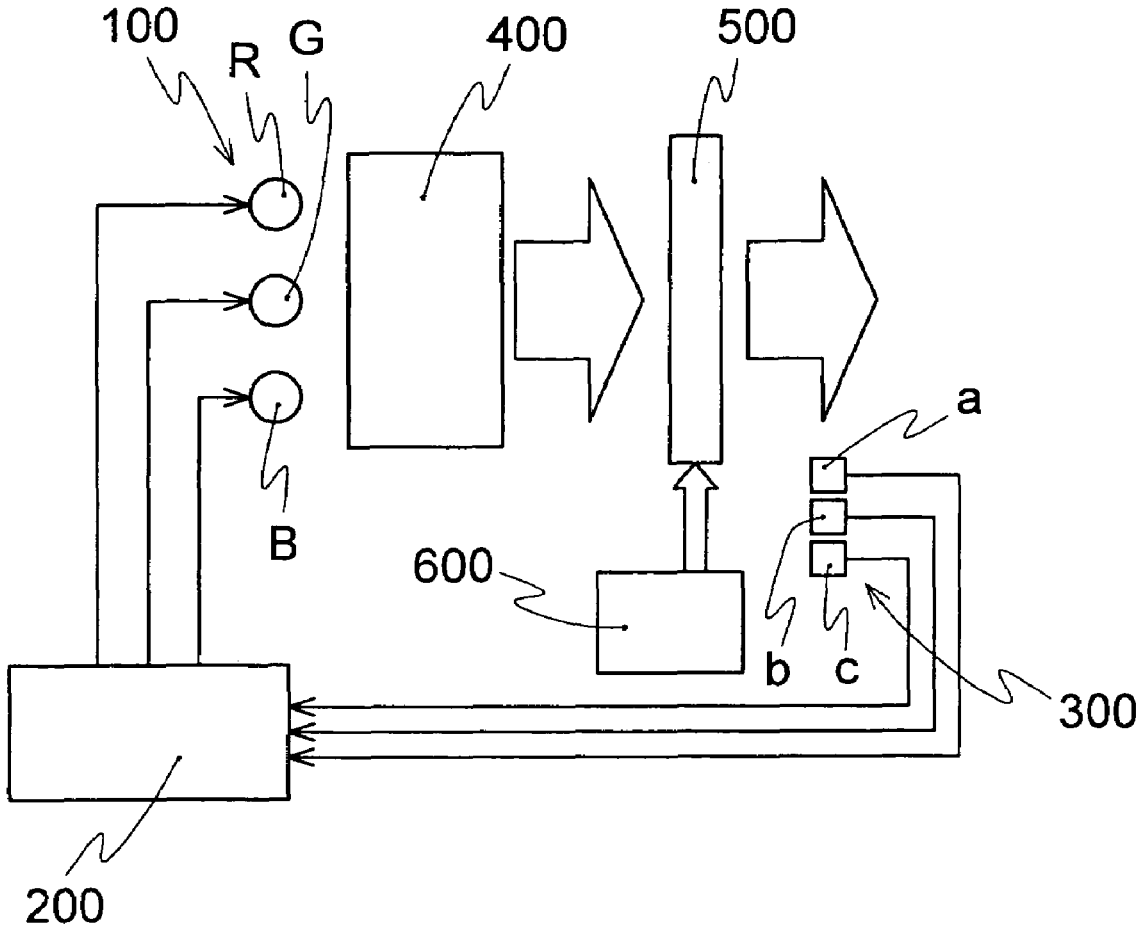
FIG. 5 is a block diagram showing a transmission type display device of Embodiment 3 of the present invention.
Figure 6:
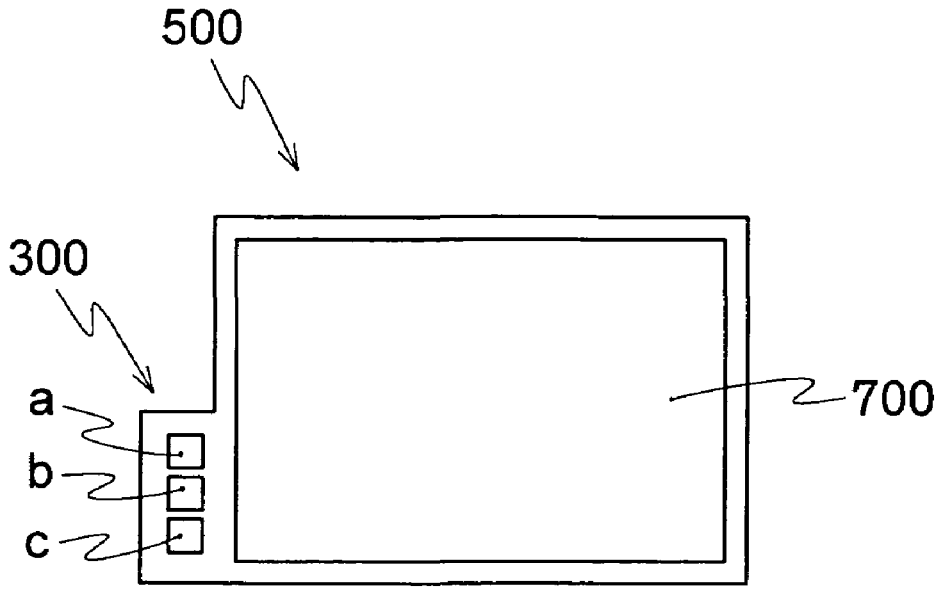
FIG. 6 is a plane view showing the positions where the optical shutter and the sensor are installed in Embodiment 3.

The present embodiment will describe a method for controlling changes in spectral transmittance of the optical shutter. FIG. 5 is a block diagram showing the transmission type display device of Embodiment 4 of the present invention. When the spectral transmittance of the optical shutter 500 changes in an extremely complicated manner and to a non-negligible degree, it is necessary to directly detect display colors and to keep the colors constant by controlling the light sources. In this case, as shown in FIG. 6, a shutter (not illustrated) having the same characteristics as the display region 700 of the optical shutter 500 is provided outside the display region 700, and the sensors a, b, and c which are the three light detection devices 300 are installed on the position. This realizes chromaticity detection by the sensors a, b, and c without affecting display.

In this case, the requirement of the spectral sensitivities required for the sensors a, b, and c is that $P(\lambda)=1$ (constant) in the formulas (10) in Embodiment 1 and the formulas (13) in Embodiment 2. In other words, the formulas (10) and (13) become the following formulas (24) and (25), respectively:

$$S_a(\lambda)=a_x x(\lambda)+a_y y(\lambda)+a_z z(\lambda)$$

$$S_b(\lambda)=b_x x(\lambda)+b_y y(\lambda)+b_z z(\lambda)$$

$$S_c(\lambda)=c_x x(\lambda)+c_y y(\lambda)+c_z z(\lambda) \tag{24}$$

$$S_a(\lambda)=a_x x(\lambda)+a_y y(\lambda)+a_z z(\lambda)+a_c$$

$$S_b(\lambda)=b_x x(\lambda)+b_y y(\lambda)+b_z z(\lambda)+b_c$$

$$S_c(\lambda)=c_x x(\lambda)+c_y y(\lambda)+c_z z(\lambda)+c_c$$

$$S_d(\lambda)=d_x x(\lambda)+d_y y(\lambda)+d_z z(\lambda)+d_c \tag{25}$$

About the selection between the formulas (24) and (25), sensors can be first selected or designed aiming at the formulas (24) and when it is not within the target precision of the emission intensities of the sensors, the formula (25) can be selected.

In this case, the shutter with the sensors fixed thereto can be set to white display so as to keep the white chromaticity constant by exactly the same control as in Embodiments 1 and 2.

In the case where the formula (23) is selected and the number of sensors is not 5 or more but 4, the same calibration as that of Embodiment 3 becomes possible. In the configuration of the present embodiment, it is not necessary to consider the temperature change of the shutter, but the calibration can reduce the influence of the temperature characteristics of the sensors if any.

Figure 7:
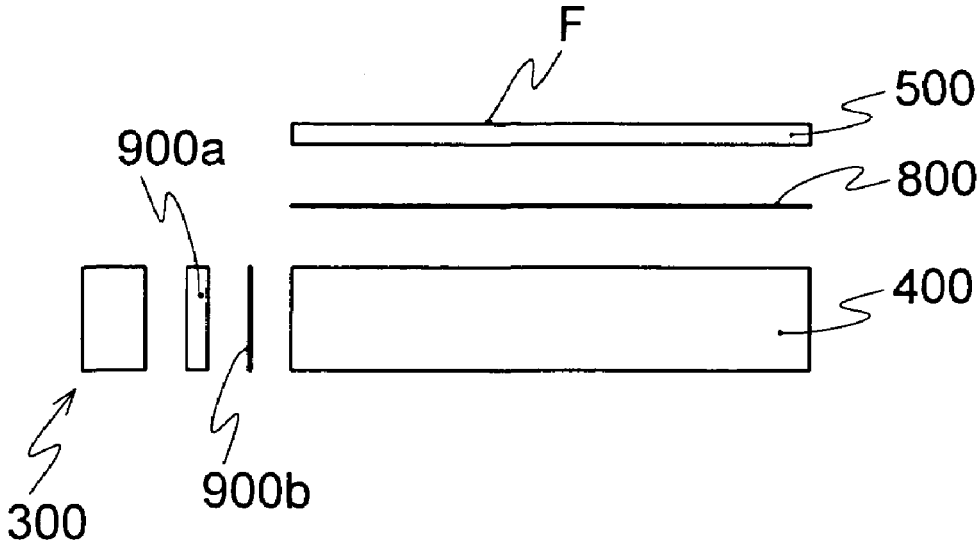
FIG. 7 is a block diagram showing another transmission type display device of Embodiment 3.

In the case where the sensors are installed not on the display surface side but inside the display device because of structural constraints, it is necessary to provide a filter having the same characteristic as the spectral transmittance from the color-blending part 400 to the display surface F in front of the light detection devices. In the case shown in FIG. 7, the light coming out from the color-blending part has its spectrum changed by the optical film 800 and the optical shutter 500. The same characteristics can be obtained by inserting a small piece of the optical film 800 as the filter **900*b* and a small piece of the optical shutter 500 as the filter 900*a*. When the optical shutter 500 is formed by a liquid crystal panel, in the fabrication process of the liquid crystal panel, a small piece of panel for filter insertion can be formed in the free area on the same substrate under the same conditions. However, the filter 900*a* must have the same transmittable spectrum as the optical shutter 500 in the white display condition. Consequently, even when the optical shutter 500 goes through a large change with temperature or time, the filter 900*a* changes in the same manner, so that the light detection devices 300** detect virtually the same light as that on the display surface, and can keep the display colors constant.

In the present embodiment, when the spectral transmittance of the optical shutter changes due to various causes, sensors can be selected and designed with an extremely wide flexibility by easing the spectral sensitivity requirements required for the sensors.

As explained hereinbefore, according to the present invention, display chromaticity can be kept in high precision. Easing the spectral sensitivity requirements of the light detection devices enables the light detection devices to be selected and designed with wide tolerances. Hence, a transmission type display device can be formed at low cost.

Though several embodiments of the present invention are described above, it is to be understood that the present invention is not limited only to the above-mentioned, various changes and modifications may be made in the invention without departing from the spirit and scope thereof.

What is claimed is:

1. Transmission type display device which is provided with plural light sources having different emission colors and which displays color images by making light emitted from said light sources pass through a color-blending part and controlling the light by an optical shutter, said transmission type display device comprising:

at least three light detection devices installed in positions closer to said light sources than is said optical shutter; and a light source control circuit which controls emission intensities of said light sources of different colors to keep display chromaticity constant so that sensitivity reading values of said light detection devices are kept constant;

wherein the spectral sensitivities of said light detection devices have characteristics at least approximately corresponding to characteristics obtained by multiplying a sum of the real number multiples of luminosity spectral characteristics by a spectral transmittance $k(\lambda)$ from said light sources to a surface of said display and then dividing by a spectral transmittance $k'(\lambda)$ from said light sources to the positions where said light detection devices are installed.

2. The transmission type display device of claim 1, wherein each of said light detection devices has a spectral sensitivity characteristic in a wavelength region where there is an emission spectrum of a respective one of said light sources.

3. Transmission type display device which is provided with plural light sources having different emission colors and which displays color images by making light emitted from said light sources pass through a color-blending part and controlling the light by an optical shutter, the transmission type display device comprising:

at least four light detection devices which are installed in positions closer to said light source than is said optical shutter and whose spectral sensitivities have characteristics at least approximately corresponding to characteristics obtained by multiplying the sum of the real number multiples of luminosity spectral characteristics by a spectral transmittance $k(\lambda)$ from said light sources to the display surface, dividing by a spectral transmittance $k'(\lambda)$ from said light sources to the positions where said light detection devices are installed, and adding up a result thereof with a real number;

a calculation part which subjects sensitivity reading values of said light detection devices to linear transformation to change into three calculation result values, using a matrix of 3 rows and n columns when the number of the light detection devices is set to n; and a light source control circuit which keeps display chromaticity constant by controlling emission intensities of the light sources having different colors, so as to keep the three calculation result values constant.

4. The transmission type display device of claim 3, wherein each of said light detection devices has a spectral sensitivity characteristic in a wavelength region where there is an emission spectrum of a respective one of said light sources.

5. Transmission type display device which is provided with plural light sources having different emission colors and which displays color images by making light emitted from said light sources pass through a color-blending part and controlling the light by an optical shutter, said transmission type display device comprising:

at least three light detection devices which are installed in positions outside a display region on a display surface side of said optical shutter; and a light source control circuit which keeps the display chromaticity constant by controlling emission intensities of the light sources having different colors so as to keep the sensitivity reading values of said light detection devices constant;

wherein spectral sensitivities of said light detection devices have characteristics at least approximately corresponding to the characteristics of the sum of the real number multiples of the luminosity spectral characteristics, and another optical shutter having the same characteristic as the display region of said optical shutter is provided in the positions where said light detection devices are installed.

6. The transmission type display device of claim 5, wherein each of said light detection devices has a spectral sensitivity characteristic in a wavelength region where there is an emission spectrum of a respective one of said light sources.

7. Transmission type display device which is provided with plural light sources having different emission colors and which displays color images by making light emitted from said light sources pass through a color-blending part and controlling the light by an optical shutter, said transmission type display device comprising:

at least three light detection devices which are installed on a light path that passes through a small piece of said optical shutter having a similar spectral transmittance to said optical shutter, said light path being provided aside from a light path leading to the display surface by branching a light path which extends from said color-blending part to said optical shutter; and a light source control circuit which keeps the display chromaticity constant by controlling emission intensities of the light sources having different colors so as to keep sensitivity reading values of said light detection devices constant;

wherein spectral sensitivities of said light detection devices have characteristics at least approximately corresponding to the characteristics of the sum of the real number multiples of the luminosity spectral characteristics, and another optical shutter, having the same characteristic as a display region of said optical shutter, is provided in the positions where said light detection devices are installed.

8. The transmission type display device of claim 7, wherein each of said light detection devices has a spectral sensitivity characteristic in a wavelength region where there is an emission spectrum of a respective one of said light sources.

9. Transmission type display device which is provided with plural light sources having different emission colors and which displays color images by making light emitted from said light sources pass through a color-blending part and controlling the light by an optical shutter, said transmission type display device comprising:

at least four light detection devices which are installed outside the display region on the display surface side of said optical shutter and whose spectral sensitivities have characteristics at least approximately corresponding to the characteristics obtained by adding a real number to the sum of the real number multiples of luminosity spectral characteristics;

a calculation part which subjects sensitivity reading values of said light detection devices to linear transformation to change them into three calculation result values using a matrix of 3 rows and n columns when the number of the light detection devices is set to n; and a light source control circuit which keeps the display chromaticity constant by controlling emission intensities, of the light sources having different colors, so as to keep the three calculation result values constant.

10. The transmission type display device of claim 9, wherein each of said light detection devices has a spectral sensitivity characteristic in a wavelength region where there is an emission spectrum of a respective one of said light sources.

11. Transmission type display device which is provided with plural light sources having different emission colors and which displays color images by making light emitted from said light sources pass through a color-blending part and controlling the light by an optical shutter, said transmission type display device comprising:

at least four light detection devices which are installed on a light path that passes through a small piece of said optical shutter having a similar spectral transmittance to said optical shutter, said light path being provided aside from a light path leading to the display surface by branching a light path which extends from said color-blending part to said optical shutter, and whose spectral sensitivities have characteristics at least approximately corresponding to characteristics obtained by adding a real number to the sum of the real number multiples of luminosity spectral characteristics, said at least four light detection devices having another optical shutter having the same characteristic as a display region of said optical shutter in the position outside the display region where said light detection devices are installed;

a calculation part which subjects sensitivity reading values of said light detection devices to linear transformation to change into three calculation result values using a matrix of 3 rows and n columns when the number of the light detection devices is set to n; and a light source control circuit which keeps the display chromaticity constant by controlling emission intensities of the light sources having different colors so as to keep the three calculation result values constant.

12. Method of controlling display colors of a transmission type display device which is provided with plural light sources having different emission colors and which displays color images by making light emitted from said light sources pass through a color-blending part and controlling the light by an optical shutter, said method comprising the steps of:

blending colors of the light emitted from said light sources and then detecting the colors with at least three light detection devices installed in positions closer to said light source than to said optical shutter;

converting the detected light into numbers;

finding error values from the numerical values and the design values of said light detection devices and then multiplying the gains or losses of the output of the light sources calculated from said light detection devices by the previous output values; and controlling emission intensities of said light sources having different colors, based on said multiplied values, so as to keep display chromaticity $D(\lambda)$ constant, wherein the spectral sensitivities of said light detection devices have characteristics at least approximately corresponding to the characteristics obtained by multiplying the sum of the real number multiples of luminosity spectral characteristics by the spectral transmittance $k(\lambda)$ from said light sources to the display surface and then dividing by the spectral transmittance $k'(\lambda)$ from said light sources to the positions where said light detection devices are installed.

13. Method, according to claim 12, of controlling and calibrating display colors of the transmission type display device which is provided with four light detection devices and light sources having at least four different colors wherein matrix elements, used in subjecting sensitivity reading values of the light detection devices to linear transformation, are obtained by applying matrix multiplication of an inverse matrix of 4 rows and 4 columns where the same color is arranged in the same column by using sensitivity reading values of the light detection devices as row elements in a matrix of 3 rows and 4 columns where the same color is arranged in the same column by using luminosity tristimulus values on the display surface which are measured with respect to four different emission colors by changing an emission ratio of the light sources.

14. Method for controlling display colors of a transmission type display device which is provided with plural light sources having different emission colors and which displays color images by making light emitted from said light sources pass through a color-blending part and controlling the light by an optical shutter, said method comprising the steps of:

blending the colors of the light emitted from said light sources, and detecting the colors by at least four light detection devices which are installed in positions closer to said light source than is said optical shutter and whose spectral sensitivities have characteristics at least approximately corresponding to characteristics obtained by multiplying the sum of the real number multiples of luminosity spectral characteristics by a spectral transmittance $k(\lambda)$ from said light sources to the display surface, dividing by a spectral transmittance from said light sources to the positions where said light detection devices are installed, and adding up the result with a real number;

calculating, to subject sensitivity reading values of said light detection devices to linear transformation to change them into three calculation result values using a matrix of 3 rows and n columns when the number of the light detection devices is set to n; and keeping the display chromaticity constant by controlling emission intensities of the light sources having different colors so as to keep the three calculation result values constant.

15. Method according to claim 14, of controlling and calibrating display colors of a transmission type display device which is provided with at least four light detection devices, wherein matrix elements, used in the calculating step of subjecting the sensitivity reading values of the light detection devices to linear transformation, are obtained by applying matrix multiplication of an inverse matrix of 4 rows and 4 columns where the same color is arranged in the same column by using sensitivity reading values of the light detection devices as row elements in the matrix of 3 rows and 4 columns where the same color is arranged in the same column, by using luminosity tristimulus values on the display surface which are measured with respect to four different emission colors by changing an emission ratio of the light sources; and wherein at least one of the four emission colors is generated under a different temperature condition of the display device from the other sources.

16. Method for controlling display colors of a transmission type display device which is provided with plural light sources having different emission colors and which displays color images by making light emitted from said light sources pass through a color-blending part and controlling the light by an optical shutter, said method comprising the steps of:

blending colors of the light emitted from said light sources and then detecting the colors with at least three light detection devices installed outside a display region of a display surface side of said optical shutter;

converting the detected light into numbers;

finding error values from the numerical values and design values of said light detection devices and then multiplying the gains or losses of the output of the light sources calculated from said light detection devices by the previous output values; and controlling emission intensities of said light sources having different colors, based on said multiplied values, so as to keep display chromaticity constant, wherein spectral sensitivities of said light detection devices have characteristics at least approximately corresponding to the characteristics of the sum of the real number multiples of the luminosity spectral characteristics, and another optical shutter having the same characteristic as the display region of said optical shutter is provided in the positions where said light detection devices are installed.

17. Method of controlling display colors of a transmission type display device which is provided with plural light sources having different emission colors and which displays color images by making light emitted from said light sources pass through a color-blending part and controlling the light by an optical shutter, said method comprising the steps of:

blending colors of the light emitted from said light sources and then detecting the colors with at least three light detection devices which are installed on a light path that passes through a small piece of said optical shutter having a similar spectral transmittance to said optical shutter, said light path being provided aside from a light path leading to the display surface by branching a light path which extends from said color-blending part to said optical shutter;

converting the detected light into numbers;

finding error values from the numerical values and design values of said light detection devices and then multiplying the gains or losses of the output of the light sources calculated from said light detection devices by the previous output values; and controlling emission intensities, of said light sources having different colors based on said multiplied values, so as to keep display chromaticity constant, wherein spectral sensitivities of said light detection devices have characteristics at least approximately corresponding to the characteristics of the sum of the real number multiples of the luminosity spectral characteristics, and another optical shutter having the same characteristic as a display region of said optical shutter is provided in the positions where said light detection devices are installed.

18. Method of controlling display colors of a transmission type display device which is provided with plural light sources having different emission colors and which displays color images by making light emitted from said light sources pass through a color-blending part and controlling the light by an optical shutter, said method comprising the steps of:

blending the colors of the light emitted from said light sources, and detecting the colors by at least four light detection devices which are installed outside a display region of a display surface side of said optical shutter and whose spectral sensitivities have characteristics at least approximately corresponding to the characteristics obtained by adding a real number to the sum of the real number multiples of luminosity spectral characteristics, said at least four light detection devices having another optical shutter having the same characteristic as the display region of said optical shutter in the position outside the display region where said light detection devices are installed;

calculating, to subject the sensitivity reading values of said light detection devices to linear transformation, to change them into three calculation result values using a matrix of 3 rows and n columns when the number of the light detection devices is set to n; and keeping the display chromaticity constant by controlling the emission intensities of the light sources having different colors so as to keep the three calculation result values constant.

19. Method of controlling display colors of a transmission type display device which is provided with plural light sources having different emission colors and which displays color images by making light emitted from said light sources pass through a color-blending part and controlling the light by an optical shutter, said method comprising the steps of:

blending the colors of the light emitted from said light sources, and detecting the colors by at least four light detection devices which are installed on a light path that passes through a small piece of said optical shutter having a similar spectral transmittance to said optical shutter, said light path being provided aside from a light path leading to the display surface by branching a light path which extends from said color-blending part to said optical shutter, and whose spectral sensitivities have characteristics at least approximately corresponding to the characteristics obtained by adding a real number to the sum of the real number multiples of luminosity spectral characteristics, said at least four light detection devices having another optical shutter, having the same characteristic as a display region of said optical shutter, installed in a position outside the display region where said light detection devices are installed;

calculating, to subject sensitivity reading values of said light detection devices to linear transformation, to change them into three calculation result values using a matrix of 3 rows and n columns when the number of the light detection devices is set to n; and keeping the display chromaticity constant by controlling emission intensities of the light sources having different colors so as to keep the three calculation result values constant.

20. A transmission display device comprising:

a light source;

a light detection device generating sensitivity reading values;

an analog/digital (A/D) converter coupled to an output of said light detection device;

a control circuit which, based on output values from said converter, maintains at least one of brightness and chromaticity constant; and means for changing a reference voltage of A/D conversion in proportion to a corresponding dimmer set ratio when the brightness or chromaticity is changed.

21. Method of controlling display colors of a transmission type display device having a light source;

a light detection device generating sensitivity reading values;

an analog/digital (A/D) converter coupled to an output of said light detection device; and a control circuit which, based on output values from said converter, maintains at least one of brightness and chromaticity constant;

said method comprising a step of changing a reference voltage of A/D conversion in proportion to a corresponding dimmer set ratio when the brightness or chromaticity is changed.

* * * * *

UNITED STATES PATENT AND TRADEMARK OFFICE

CERTIFICATE OF CORRECTION

PATENT NO. : 7,436,386 B2
APPLICATION NO. : 10/741006
DATED : October 14, 2008
INVENTOR(S) : Kazuhiro Ishiguchi It is certified that error appears in the above-identified patent and that said Letters Patent is hereby corrected as shown below:

Column 6 at line 46, please delete “AID” and insert --A/D-- therefor.

Column 7 at line 50, please delete “;” and insert --.-- therefor.

Column 8 at line 32, please delete “sides” and insert --side,-- therefor.

Column 8 at line 32, after the second occurrence of “side” please insert --,--.

Column 9 at line 58, please delete “lift” and insert --left-- therefor.

Signed and Sealed this

Ninth Day of June, 2009

John Doll

JOHN DOLL
*Acting Director of the United States Patent and Trademark Office*